US007150658B1

(12) United States Patent
Chien

(10) Patent No.: US 7,150,658 B1
(45) Date of Patent: Dec. 19, 2006

(54) TERMINAL FOR AN ELECTRICAL CONNECTOR

(75) Inventor: Duke Chien, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 11/455,088

(22) Filed: Jun. 19, 2006

(51) Int. Cl.
*H01R 13/24* (2006.01)

(52) U.S. Cl. ..... 439/700; 439/824

(58) Field of Classification Search ..... 439/700, 439/824, 482, 289
See application file for complete search history.

(56) References Cited

U.S. PATENT DOCUMENTS 4,906,194 A * 3/1990 Grabbe ..... 439/71
6,290,524 B1 * 9/2001 Simmel ..... 439/289

* cited by examiner

*Primary Examiner*—Hae Moon Hyeon
(74) *Attorney, Agent, or Firm*—Davidson Berquist Jackson & Gowdey, LLP

(57) ABSTRACT

A terminal includes first and second base portions, first and second contact portions, first and second protruding portions, first and second spring arm portions, and an abutting portion. The first contact portion extends from the first base portion. The second contact portion extends from the second base portion. The first protruding portion extends from the first base portion. The second protruding portion extends from the second base portion and is aligned with the first protruding portion. A first connecting portion connects the first spring arm portion to the first base portion. A second connecting portion connects the second spring arm portion to the second base portion. The abutting portion extends between the first and second spring arm portions, and has opposite ends aligned with and spaced apart from the first and second protruding portions, respectively.

3 Claims, 6 Drawing Sheets

TERMINAL FOR AN ELECTRICAL CONNECTOR

BACKGROUND OF THE INVENTION

1. Field of the Invention

This invention relates to a terminal for an electrical connector, more particularly to a terminal that has a strong structural strength.

2. Description of the Related Art

FIGS. 1 and 2 illustrate a conventional terminal 1 for an electrical connector 2. The electrical connector 2 includes a dielectric body 21. The terminal 1 includes a base portion 11 that is disposed in the dielectric body 21 of the electrical connector 2, a first contact portion 13 that extends from the base portion 11 and that is disposed externally of the dielectric body 21 of the electrical connector 2, a second contact portion 14 that is disposed externally of the dielectric body 21 of the electrical connector 2, and a meandering portion 15 that is disposed in the dielectric body 21 and that interconnects the base portion 11 and the second contact portion 14.

The aforementioned conventional terminal 1 is disadvantageous in that it has a weak structural strength. That is, when an external force is applied to the second contact portion 14 during installation of the electrical connector 2, the meandering portion 15 tends to be easily and permanently deformed.

SUMMARY OF THE INVENTION

Therefore, the object of the present invention is to provide a terminal for an electrical connector that can overcome the aforesaid drawback of the prior art.

According to the present invention, a terminal for an electrical connector comprises first and second base portions, first and second contact portions, first and second protruding portions, first and second connecting portions, first and second spring arm portions, and an abutting portion. The second base portion is opposite to the first base portion in a first direction. The first contact portion extends from the first base portion away from the second base portion. The second contact portion extends from the second base portion in the first direction away from the first base portion. The first protruding portion extends from the first base portion in the first direction toward the second base portion. The second protruding portion extends from the second base portion in the first direction toward the first base portion and is aligned with the first protruding portion in the first direction. The first connecting portion is opposite to the first protruding portion in a second direction transverse to the first direction and extends from the first base portion. The second connecting portion is opposite to the second protruding portion in the second direction and extends from the second base portion. The first spring arm portion extends from the first connecting portion. The second spring arm portion extends from the second connecting portion. The abutting portion extends between the first and second spring arm portions, and has a first end that is aligned with and that is spaced apart from the first protruding portion in the first direction, and a second end that is opposite to the first end of the abutting portion in the first direction and that is aligned with and that is spaced apart from the second protruding portion in the first direction. Accordingly, when an external force is applied to the second contact portion, the second base portion moves toward the first base portion to result in deformation of the first and second spring arm portions and respective abutment of the first and second protruding portions against the first and second ends of the abutting portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
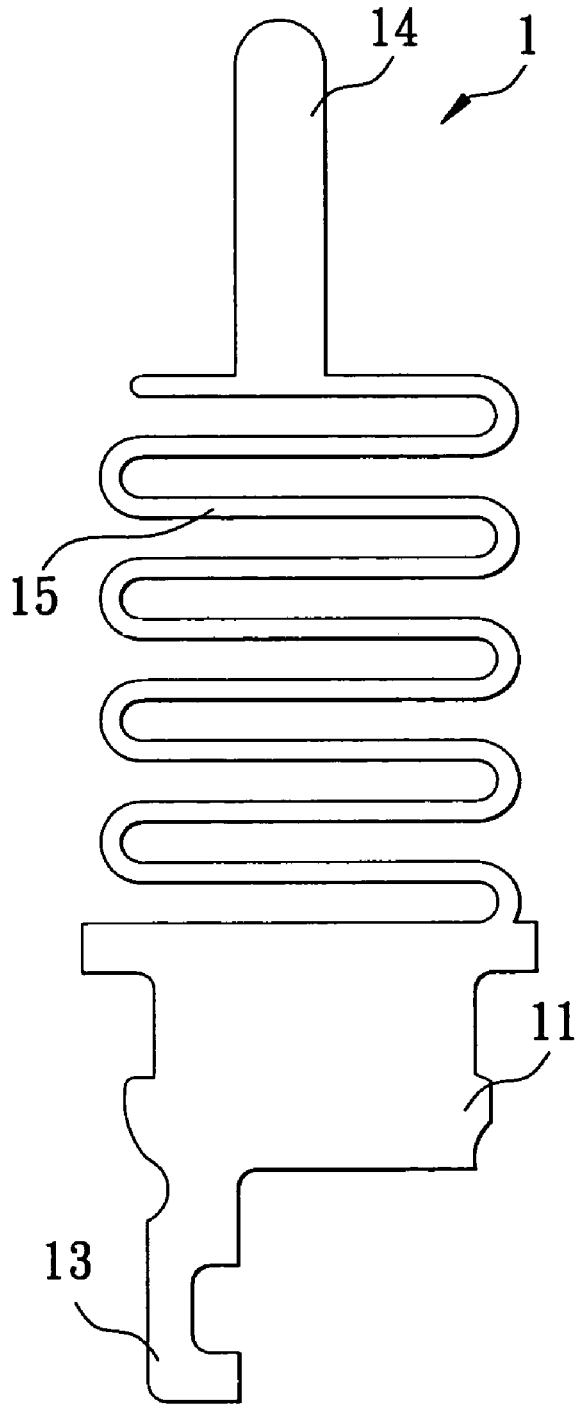
FIG. 1 PRIOR ART
FIG. 1 is a schematic view of a conventional terminal for an electrical connector.
Figure 2:
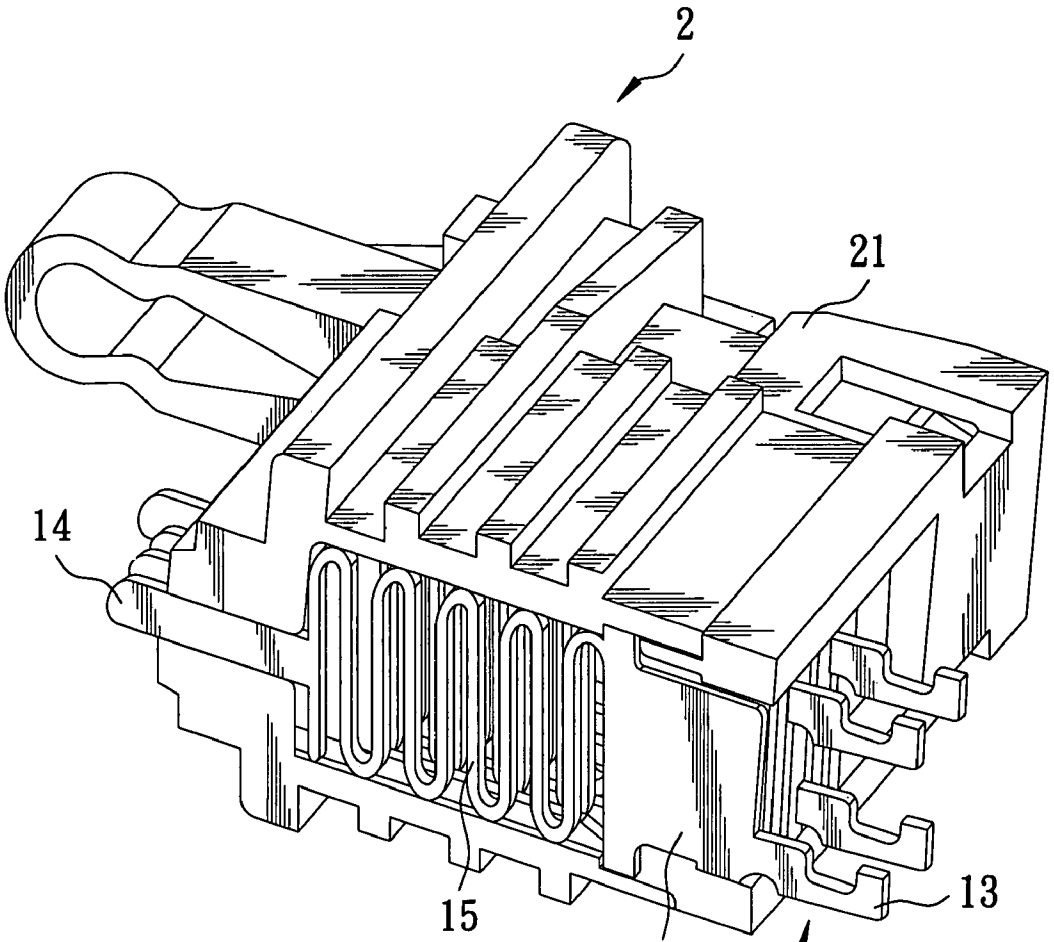
FIG. 2 PRIOR ART
FIG. 2 is a perspective view of the electrical connector with the conventional terminal disposed in a dielectric body.
Figure 3:
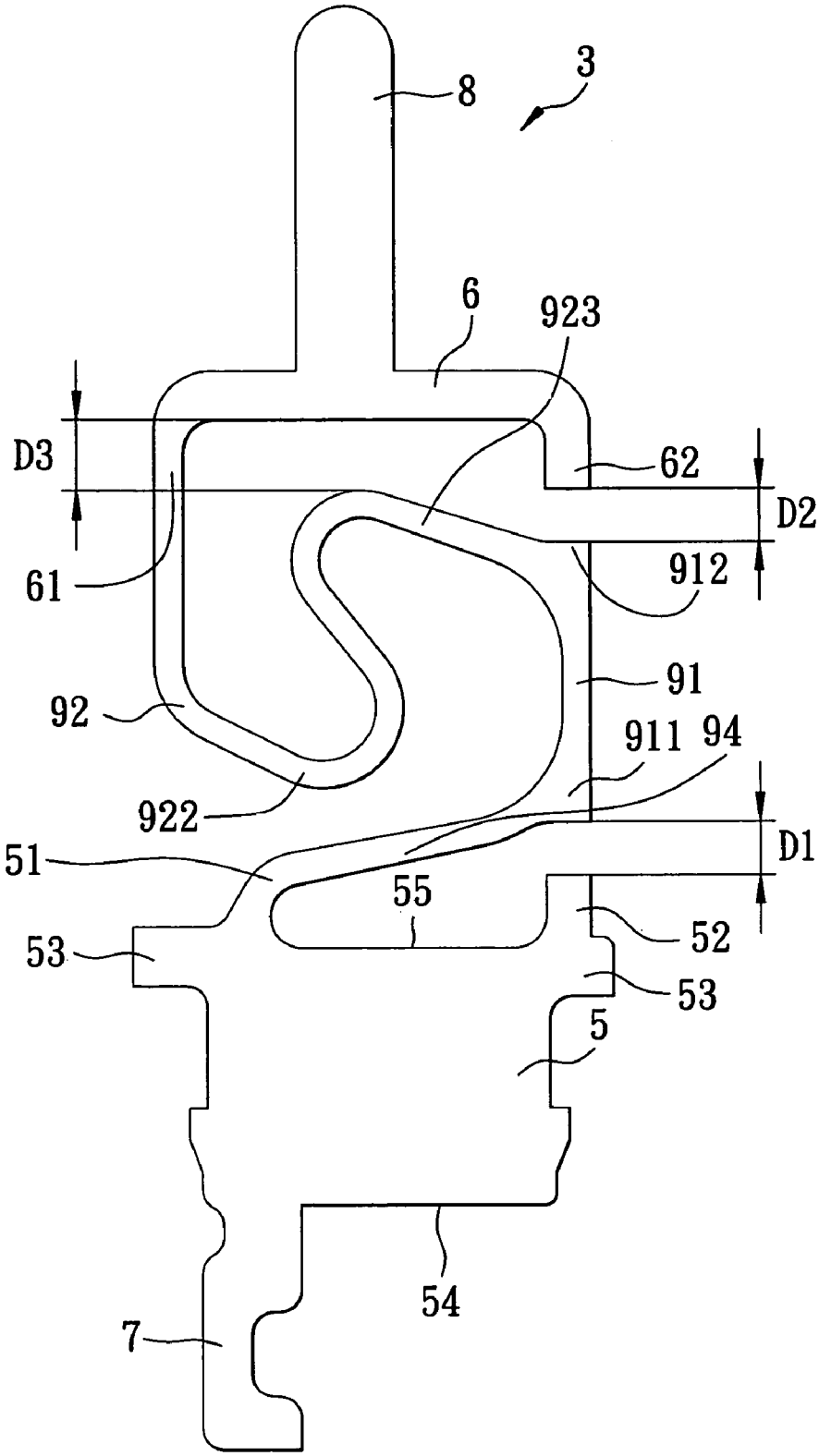
FIG. 3 is a schematic view of the preferred embodiment of a terminal for an electrical connector according to the present invention.
Figure 4:
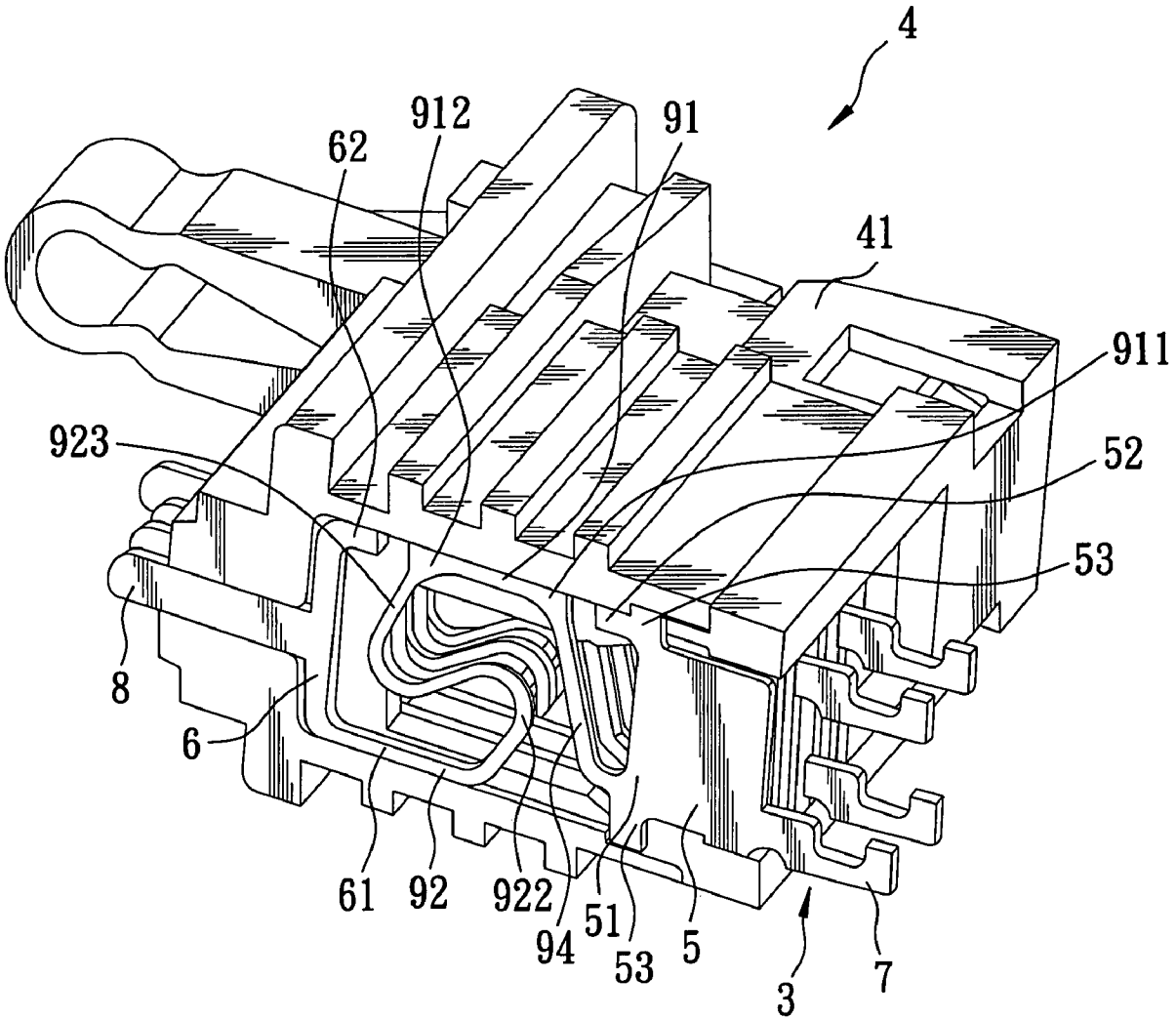
FIG. 4 is a perspective view of the electrical connector with the preferred embodiment disposed in a dielectric body.

Referring to FIGS. 3 and 4, the preferred embodiment of a terminal 3 for an electrical connector 4 according to this invention includes first and second base portions 5, 6, first and second contact portions 7, 8, first and second protruding portions 52, 62, first and second connecting portions 51, 61, first and second spring arm portions 94, 92, and an abutting portion 91.

The electrical connector 4 includes a dielectric body 41.

The first base portion 5 is disposed in the dielectric body 41, is generally rectangular in shape, and has first and second sides 54, 55 that are opposite to each other in a first direction.

The second base portion 6 is disposed in the dielectric body 41, and is opposite to the first base portion 5 in the first direction.

The first contact portion 7 extends from the first side 54 of the first base portion 5 in the first direction away from the second base portion 6, and is disposed externally of the dielectric body 41.

The second contact portion 8 extends from the second base portion 6 away from the first base portion 5 in the first direction, and is disposed externally of the dielectric body 41.

The first protruding portion 52 extends from the second side 55 of the first base portion 5 in the first direction toward the second base portion 6.

The second protruding portion 62 extends from the second base portion 6 in the first direction toward the first base portion 5 and is aligned with the first protruding portion 52 in the first direction.

The first connecting portion 51 is disposed opposite to the first protruding portion 52 in a second direction transverse to the first direction, and extends from the second side 55 of the first base portion 5.

The second connecting portion 61 is disposed opposite to the second protruding portion 62 in the second direction, and extends from the second base portion 6.

The first spring arm portion 94 is disposed in the dielectric body 41, and extends from the first connecting portion 51.

The second spring arm portion 92 is disposed in the dielectric body 41, is generally S-shaped, extends from the second connecting portion 61, and has a pair of first and second U-shaped segments 922, 923 that are respectively disposed proximate to the first and second base portions 5, 6.

The abutting portion 91 is generally straight, extends between the first and second spring arm portions 94, 92, and has a first end 911 that is aligned with and that is spaced apart from the first protruding portion 52 in the first direction, and a second end 912 that is opposite to the first end 911 of the abutting portion 91 and that is aligned with and that is spaced apart from the second protruding portion 62 in the first direction.

As best shown in FIG. 3, the first protruding portion 52 and the first end 911 of the abutting portion 91 are spaced apart by a first distance (D1). The second protruding portion 62 and the second end 912 of the abutting portion 91 are spaced apart by a second distance (D2). The second U-shaped segment 923 of the second spring arm portion 92 and the second base portion 6 are spaced apart by a third distance (D3), which is the shortest distance therebetween. It is noted that, in this embodiment, the third distance (D3) is less than the first and second distances (D1, D2). Moreover, the first and second distances (D1, D2) are equal.

The terminal 3 further includes a pair of engaging protrusions 53, each of which engages a respective one of engaging grooves (not shown) in the dielectric body 41 for retaining the terminal 3 of this invention in the dielectric body 41.

Figure 5:
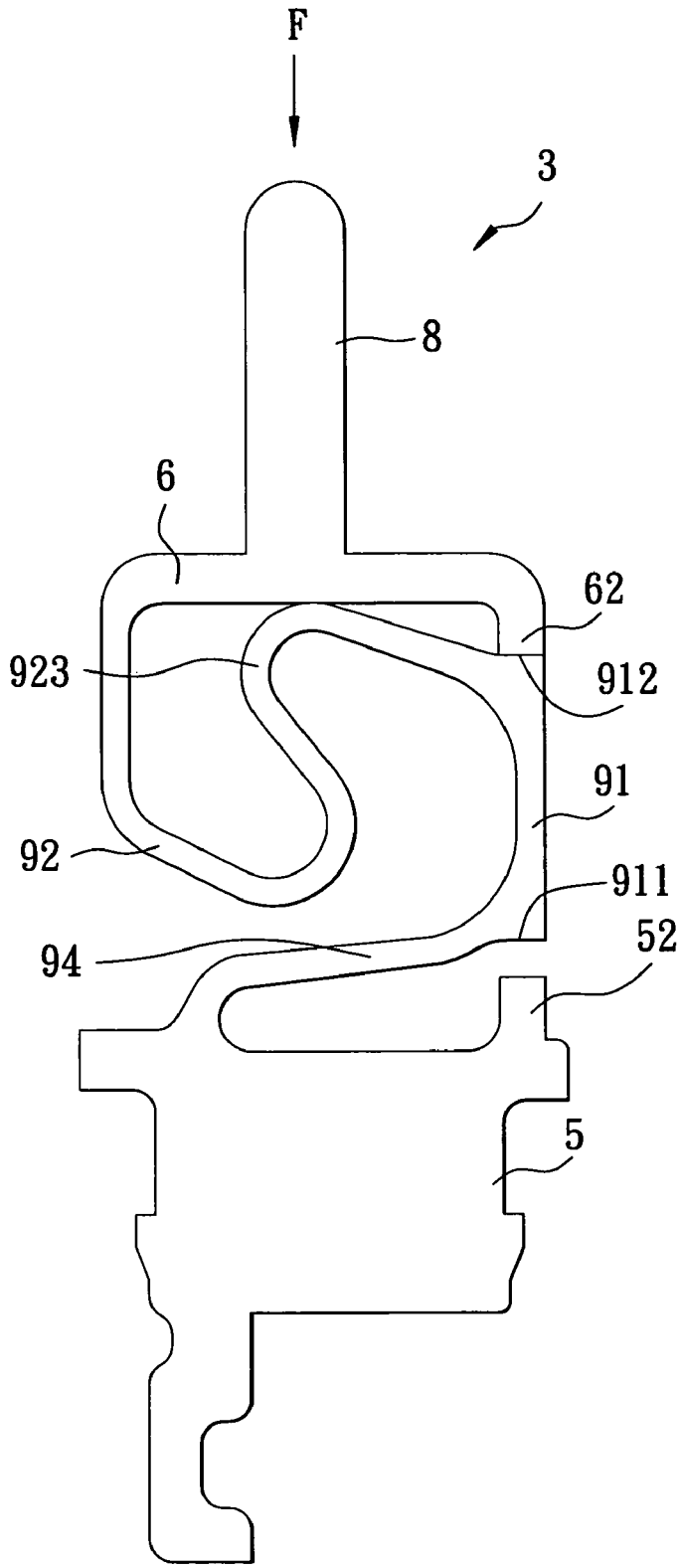
FIG. 5 is a schematic view to illustrate a spring arm portion of the preferred embodiment in a deformed state.
Figure 6:
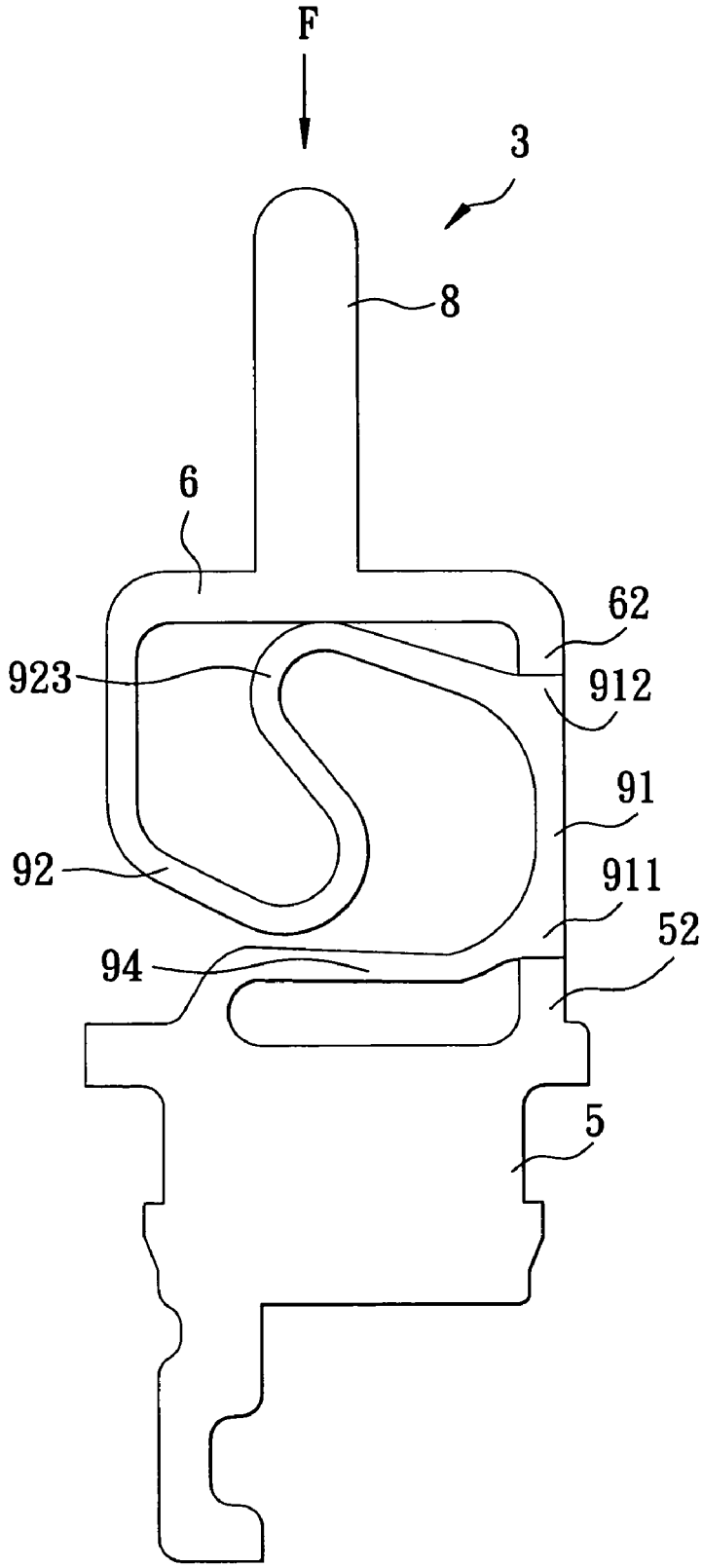
FIG. 6 is a schematic view to illustrate both spring arm portions of the preferred embodiment in a deformed state.

From the above description, with further reference to FIGS. 5 and 6, when an external force (F) is applied to the second contact portion 8 during installation of the electrical connector 4 (see FIG. 4), this results in movement of the second base portion 6 in the first direction toward the first base portion 5, deformation of the first and second spring arm portions 94, 92, and respective abutment of the first and second protruding portions 52, 62, and the second base portion 6 against the first and second ends 911, 912 of the abutting portion 91, and the second U-shaped segment 923 of the second spring arm portion 92. As such, the second base portion 6 is prevented from moving further toward the first base portion 5, thereby avoiding permanent deformation of the first and second spring arm portions 94, 92. The terminal 3 of this invention therefore has a relatively strong structural strength.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A terminal for an electrical connector comprising:

a first base portion;

a second base portion opposite to said first base portion in a first direction;

a first contact portion extending from said first base portion away from said second base portion;

a second contact portion extending from said second base portion in the first direction away from said first base portion;

a first protruding portion extending from said first base portion in the first direction toward said second base portion;

a second protruding portion extending from said second base portion in the first direction toward said first base portion and aligned with said first protruding portion in the first direction;

a first connecting portion opposite to said first protruding portion in a second direction transverse to the first direction and extending from said first base portion;

a second connecting portion opposite to said second protruding portion in the second direction and extending from said second base portion;

a first spring arm portion extending from said first connecting portion;

a second spring arm portion extending from said second connecting portion; and an abutting portion extending between said first and second spring arm portions, and having a first end that is aligned with and that is spaced apart from said first protruding portion in the first direction, and a second end that is opposite to said first end of said abutting portion in the first direction and that is aligned with and that is spaced apart from said second protruding portion in the first direction;

wherein when an external force is applied to said second contact portion, said second base portion moves toward said first base portion to result in deformation of said first and second spring arm portions and respective abutment of said first and second protruding portions against said first and second ends of said abutting portion.

2. The terminal as claimed in claim 1, wherein said first spring arm portion is generally S-shaped, and has first and second U-shaped segments that are respectively disposed proximate to said first and second base portions, said second base portion abutting against said second U-shaped segment of said second spring arm portion when said second protruding portion abuts against said second end of said abutting portion.

3. The terminal as claimed in claim 2, wherein said first and second protruding portions are spaced apart from said first and second ends of said abutting portion at equal distances.

* * * * *